US005333522A

United States Patent [19]

Prather et al.

[11] Patent Number: 5,333,522

[45] Date of Patent: Aug. 2, 1994

[54] OIL FILTER WRENCHES WITH SELF TIGHTENING CAPABILITIES

[76] Inventors: Don G. Prather; Hugh M. Prather, both of 5933 Westminister Dr., Austin, Tex. 78723

[21] Appl. No.: 150,993

[22] Filed: Nov. 12, 1993

[51] Int. Cl.[5] ..... B25B 13/52

[52] U.S. Cl. ..... 81/64

[58] Field of Search ..... 81/64, 65, 65.2, 68, 81/69, 3.43

[56] References Cited

U.S. PATENT DOCUMENTS

| | | | |
|---|---|---|---|
| 3,838,615 | 10/1974 | McFarland et al. | 81/64 |
| 4,114,481 | 9/1978 | Kowalczyk | 81/64 |
| 4,916,993 | 4/1990 | Siekawitch | 81/3.43 X |
| 5,090,274 | 2/1992 | Schaub | 81/64 |

*Primary Examiner*—D. S. Meislin
*Attorney, Agent, or Firm*—Michael J. Colitz, Jr.

[57] ABSTRACT

An oil filter wrench with self tightening capabilities for grasping and rotating a cylindrical oil filter can comprising, in combination, a wrench for grasping and rotating a cylindrical object filter can comprising, a strap fabricated of a flexible material having a fixed end and a free end, a ring platform with the fixed end of the strap slidably coupled thereto, an arcuate guide slot formed in the ring platform with a roller slidable therealong, the roller being coupled to the fixed end of the strap to allow limited sliding movement of the roller and the fixed end of the strap with respect to the ring platform, a spring resiliently coupling the roller and the free end of the strap to the ring platform, a flexible cable coupled at one end to the free end of the strap and guide means to control the movement of the cable with respect to the free end of the strap, and a handle coupled the ring platform to effect rotation of the strap with respect to a cylindrical object held by the strap and coupled to the other end of the cable for pulling the cable to tighten the strap around the object whereby continued pulling of the cable by the minor handle will grasp and rotate the object.

5 Claims, 3 Drawing Sheets

OIL FILTER WRENCHES WITH SELF TIGHTENING CAPABILITIES

BACKGROUND OF THE INVENTION

1. Field of the Invention

The present invention relates to oil filter wrenches with self tightening capabilities and more particularly pertains to oil filter wrenches with a handle and cable arrangement to effect tightening of the wrench while loosening the oil filter.

2. Description of the Prior Art

The use of oil filter wrenches is known in the prior art. More specifically, oil filter wrenches heretofore devised and utilized for the purpose of loosening and removing used oil filters are known to consist basically of familiar, expected and obvious structural configurations, notwithstanding the myriad of designs encompassed by the crowded prior art which have been developed for the fulfillment of countless objectives and requirements.

The prior art discloses many types of wrenches. By way of example, U.S. Pat. No. 5,090,274 to Schaub discloses an oil filter wrench with two coupled ends.

U.S. Pat. No. 4,916,993 to Siekawytch discloses an oil filter wrench with both ends of the ring coupled to a handle.

U.S. Pat. No. 4,114,481 to Kowalczwk discloses an oil filter wrench operable through a ratchet drive.

U.S. Pat. No. 3,838,615 to McFarland discloses an oil filter wrench with a handle supporting both ends of a ring.

Designs for oil filter wrenches are disclosed in U.S. Pat. No. 307,101 to Anderson and 328,554 to Cobble.

In this respect, the oil filter wrenches with self tightening capabilities according to the present invention substantially departs from the conventional concepts and designs of the prior art, and in so doing provides an apparatus primarily developed for the purpose of loosening and removing used oil filters.

Therefore, it can be appreciated that there exists a continuing need for new and improved oil filter wrenches with self tightening capabilities which can loosen and remove oil filter cans. In this regard, the present invention substantially fulfills this need.

SUMMARY OF THE INVENTION

In view of the foregoing disadvantages inherent in the known types of oil filter wrenches now present in the prior art, the present invention provides an improved oil filter wrenches with self tightening capabilities. As such, the general purpose of the present invention, which will be described subsequently in greater detail, is to provide a new and improved oil filter wrenches with self tightening capabilities apparatus and method which has all the advantages of the prior art and none of the disadvantages.

To attain this, the present invention essentially comprises an oil filter wrench with self tightening capabilities for grasping and rotating a cylindrical oil filter can comprising, in combination, a strap fabricated of a flexible inextensible material having a fixed end and a free end, a ring platform with the fixed end of the strap slidably coupled thereto, an arcuate guide slot formed in the ring platform with a roller slidable therealong, the roller being coupled to the fixed end of the strap to allow limited sliding movement of the roller and the fixed end of the strap with respect to the ring platform, a spring resiliently coupling the roller and the free end of the strap to the ring platform, a flexible cable having a first end and a second end coupled at its first end to the free end of the strap and guide means to control the movement of the cable with respect to the free end of the strap, a major handle coupled to the ring platform to effect rotation of the strap with respect to an oil filter can when held by the strap, and a minor handle coupled to the second end of the cable, the minor handle pivotable with respect to the major handle for pulling the cable to tighten the strap around the oil filter can whereby continued pulling of the cable by the minor handle will grasp and rotate the oil filter can.

There has thus been outlined, rather broadly, the more important features of the invention in order that the detailed description thereof that follows may be better understood, and in order that the present contribution to the art may be better appreciated, There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is a further object of the present invention to provide new and improved oil filter wrenches with self tightening capabilities which are of a durable and reliable construction.

An even further object of the present invention is to provide new and improved oil filter wrenches with self tightening capabilities which are susceptible of a low cost of manufacture with regard to both materials and labor, and which accordingly are then susceptible of low prices of sale to the consuming public, thereby making such oil filter wrenches with self tightening capabilities economically available to the buying public.

Still yet another object of the present invention is to provide new and improved oil filter wrenches with self tightening capabilities which provides in the apparatuses and methods of the prior art some of the advantages thereof, while simultaneously overcoming some of the disadvantages normally associated therewith.

Still another object of the present invention is to twist off oil filters while tightening the grip of the tool.

Yet another object of the present invention is to tighten the grip of a tool on an oil filter while twisting off such oil filter.

Even still another object of the present invention is to provide new and improved oil filter wrench with self tightening capabilities for grasping and rotating a cylindrical oil filter can comprising a wrench for grasping and rotating a cylindrical object filter can comprising, a strap fabricated of a flexible material having a fixed end and a free end, a ring platform with the fixed end of the strap slidably coupled thereto, an arcuate guide slot formed in the ring platform with a roller slidable therealong, the roller being coupled to the fixed end of the strap to allow limited sliding movement of the roller and the fixed end of the strap with respect to the ring platform, a spring resiliently coupling the roller and the free end of the strap to the ring platform, a flexible cable coupled at one end to the free end of the strap and guide means to control the movement of the cable with respect to the free end of the strap, and a handle coupled the ring platform to effect rotation of the strap with respect to a cylindrical object held by the strap and coupled to the other end of the cable for pulling the cable to tighten the strap around the object whereby continued pulling of the cable by the minor handle will grasp and rotate the object.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
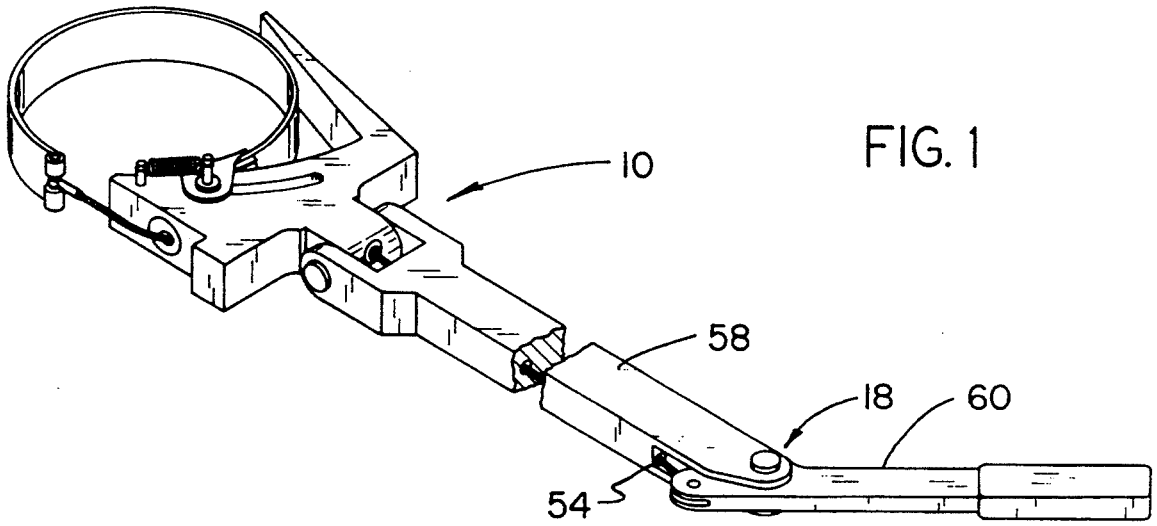
FIG. 1 is a perspective illustration of the preferred embodiment of an oil filter wrench constructed in accordance with the principles of the present invention.
Figure 2:
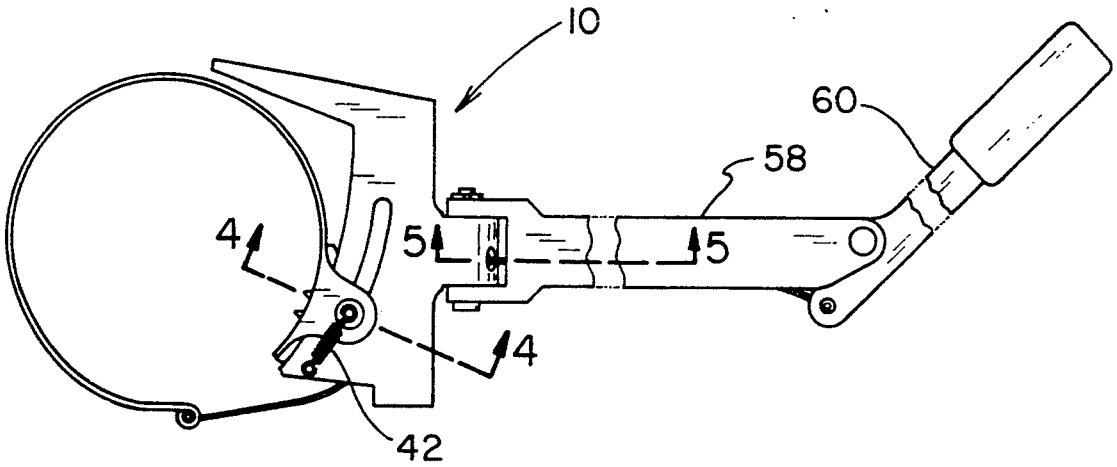
FIG. 2 is a plan view of the oil filter wrench shown in FIG. 1.
Figure 3:
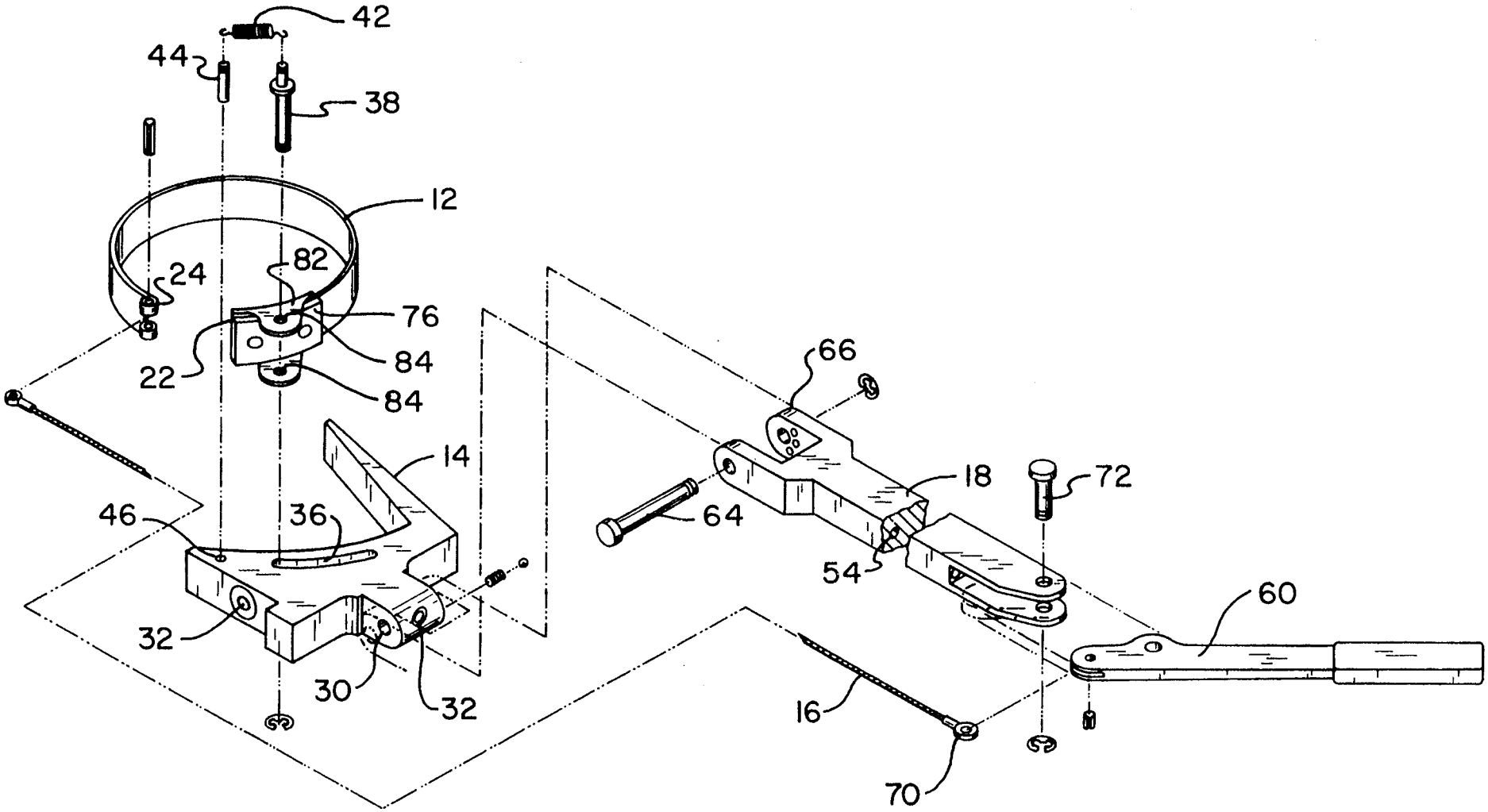
FIG. 3 is an exploded perspective view of the oil filter wrench of the prior Figures.

With reference now to the drawings, and in particular to FIG. 1 thereof, a new and improved oil filter wrenches with self tightening capabilities embodying the principles and concepts of the present invention and generally designated by the reference numeral 10 will be described.

More specifically, it will be noted that there is shown in FIGS. 1 through 5 an oil filter wrench 10 with self tightening capabilities for grasping and rotating a conventional cylindrical oil filter can, not shown. The wrench 10 comprises, in its broadest terms, a strap 12, a ring platform 14, a flexible cable 16 and a handle 18.

More specifically, the strap 12 is fabricated of a flexible, inextensible material such as a spring steel. It has a fixed end 22 and a free end 24.

Next provided is a ring platform 14. The a ring platform 14 is formed with the fixed end 22 of the strap 12 slidably coupled thereto. The ring platform also has an aperture 30 for coupling with the handle 18 and a passageway 32 for the movement therethrough of the cable 16.

An arcuate guide slot 36 is formed in the ring platform 14. A roller 38 is slidable therealong. The roller is coupled to the fixed end 22 of the strap 12 to allow limited sliding movement of the roller 38 and the fixed end 22 of the strap 12 with respect to the ring platform 14.

A spring 42 resiliently couples the roller and the fixed end 22 of the strap 12 to the ring platform 14. This is effected by coupling one end of the spring to the roller 38 and the other end to pin 44 secured to the ring platform through a hole 46.

A flexible cable 16 is provided. It has a first end 50 and a second end 70. The first end 50 is coupled to the free end 24 of the strap 14. Guide means in the form of passageway 32 in the ring platform and a supplemental passageway 54 in the handle 18 act to control the movement of the cable with respect to the free end 24 of the strap 14.

The handle 18 is fomed of a major handle 58 and a minor handle 60. The major handle 58 is coupled to the ring platform through pin 64. The coupling is to effect rotation of the strap 12 with respect to an oil filter can when held by the strap. The pin 64 passes through hole 30 in the ring platform 14 and a clevis 66 in the end of the handle 18 to allow swivel of the handle 18 with respect to the ring platform 14.

The minor handle 60 is coupled to a second end 70 of the cable 16. The minor handle is pivotably connected to the major handle 58 through pin 72 extending through adjacent ends of the handle portions. Such pivotable coupling is for pulling the cable to tighten the strap around the oil filter can. In this manner, continued pulling of the cable by the minor handle will grasp and rotate the oil filter can held by the strap 12.

Figure 4:
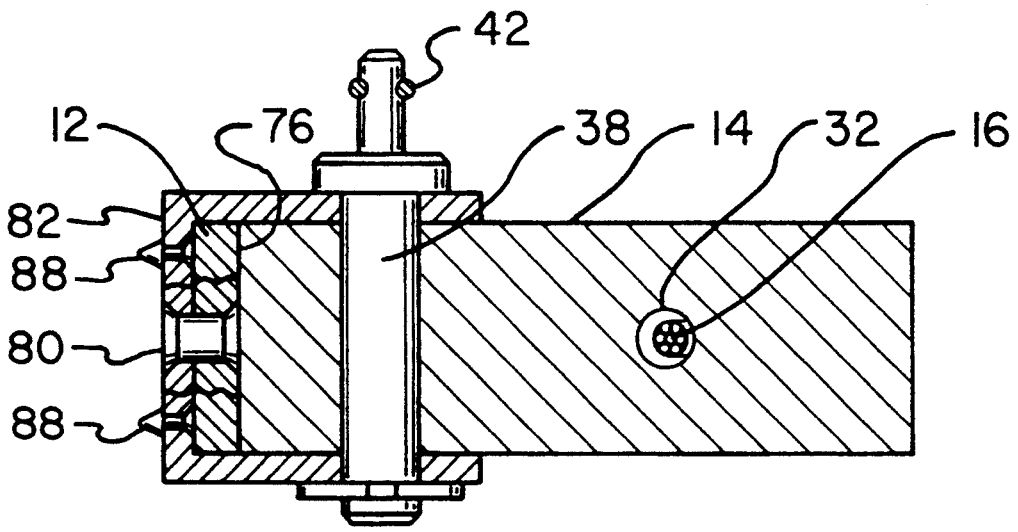
FIG. 4 is a sectional view taken along line 4—4 of FIG. 2.
Figure 5:
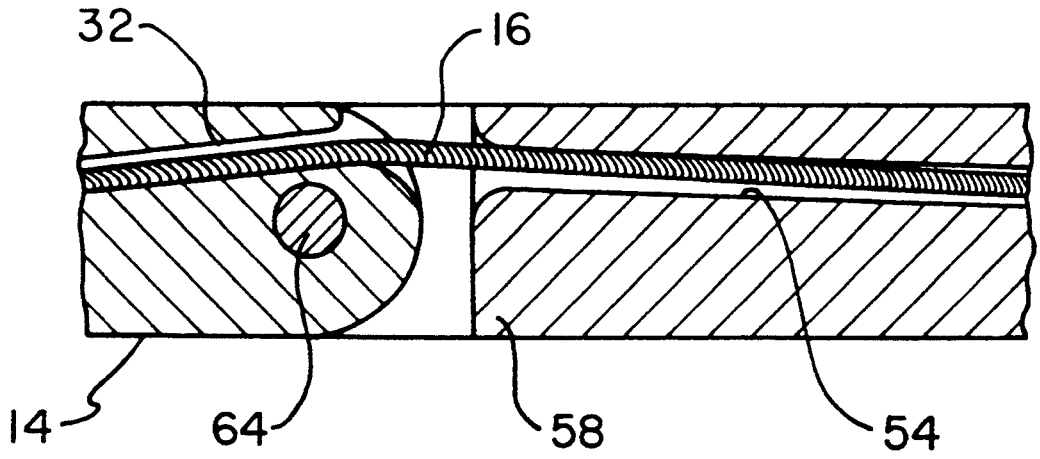
FIG. 5 is a sectional view taken along line 5—5 of FIG. 2.

FIG. 4 shows a bearing sheet 76 fabricated of a lubricious matrial, preferably Teflon. Such sheet is secured to the surface of the strap 12 adjacent its free end 22 to ride against the adjacent surface of the ring platform. Coupling is through a rivet 80. Riveting is through a C-shaped memeber 82 formed with apertures 84 which support the ends of the roller 38. Note is taken that the member 82 is provided with cone-shpaed projections 88 which indent into the cylinder being grasped to preclude sliding movement between the strap and filter can. Lastly, FIG. 5 illustrate the passageways 32 and 54 as being formed with chambered openings to ensure movement therebetween.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An oil filter wrench with self tightening capabilities for grasping and rotating a cylindrical oil filter can comprising, in combination:

a strap fabricated of a flexible inextensible material having a fixed end and a free end;

a ring platform with the fixed end of the strap slidably coupled thereto;

an arcuate guide slot formed in the ring platform with a roller slidable therealong, the roller being coupled to the fixed end of the strap to allow limited sliding movement of the roller and the fixed end of the strap with respect to the ring platform;

a spring resiliently coupling the roller and the fixed end of the strap to the ring platform;

a flexible cable having a first end and a second end coupled at its first end to the free end of the strap and guide means to control the movement of the cable with respect to the free end of the strap;

a major handle coupled to the ring platform to effect rotation of the strap with respect to an oil filter can when held by the strap; and a minor handle coupled to the second end of the cable, the minor handle pivotable with respect to the major handle for pulling the cable to tighten the strap around the oil filter can whereby continued pulling of the cable by the minor handle will grasp and rotate the oil filter can.

2. A wrench for grasping and rotating a cylindrical object filter can comprising:

a strap fabricated of a flexible material having a fixed end and a free end;

a ring platform with the fixed end of the strap slidably coupled thereto;

an arcuate guide slot formed in the ring platform with a roller slidable therealong, the roller being coupled to the fixed end of the strap to allow limited sliding movement of the roller and the fixed end of the strap with respect to the ring platform;

a spring resiliently coupling the roller and the fixed end of the strap to the ring platform;

a flexible cable coupled at one end to the free end of the strap and guide means to control the movement of the cable with respect to the free end of the strap; and a handle coupled the ring platform to effect rotation of the strap with respect to a cylindrical object held by the strap and coupled to the other end of the cable for pulling the cable to tighten the strap around the object whereby continued pulling of the cable by the handle will grasp and rotate the object.

3. The apparatus as set forth in claim 2 wherein the handle is pivotally coupled to the ring platform about an axis perpendicular to the handle.

4. The apparatus as set forth in claim 2 wherein the handle is formed of a major portion and a minor portion pivotally coupled with respect to each other.

5. The apparatus as set forth in claim 4 wherein the other end of the cable is coupled to the minor portion of the handle whereby movement thereof tightens the cable and the strap around the object.

* * * * *